US005832733A

United States Patent [19]

Shimotani et al.

[11] Patent Number: 5,832,733

[45] Date of Patent: Nov. 10, 1998

[54] POWER CONTROLLABLE TYPE AIR CONDITIONER

[75] Inventors: Makoto Shimotani; Takao Shiina, both of Oizumi-machi, Japan

[73] Assignee: Sanyo Electric Co., LTD, Osaka, Japan

[21] Appl. No.: 808,943

[22] Filed: Feb. 19, 1997

[30] Foreign Application Priority Data

Feb. 23, 1996 [JP] Japan ..... 8-062018
Feb. 23, 1996 [JP] Japan ..... 8-062019

[51] Int. Cl.[6] ..... F24F 1/00

[52] U.S. Cl. ..... 62/196.2; 62/510; 62/228.5

[58] Field of Search ..... 62/196.3, 196.1, 62/196.2, 228.5, 175, 510; 236/1 E, 1 EA, 1 EB

[56] References Cited

U.S. PATENT DOCUMENTS 2,961,148 11/1960 Courtney, Jr. ..... 62/196.2 X
4,335,582 6/1982 Shaw et al. ..... 62/196.1
4,494,383 1/1985 Nagatomo et al. ..... 62/196.2
5,361,595 11/1994 Shimura et al. ..... 62/175

*Primary Examiner*—Harry B. Tanner
*Attorney, Agent, or Firm*—Darby & Darby

[57] ABSTRACT

In an air conditioner in which plural outdoor units are connected to plural indoor units, at least one outdoor unit is provided with a compressor having a power control mechanism for inhibiting a part of a compression work, and the power of the compressor is made variable by controlling the power control mechanism. The outdoor unit is provided with two heat exchangers which are designed in a substantially U-shaped form, and disposed in a main body of the outdoor unit so that the opening sides thereof are confronted to each other, and the refrigerating elements which constitutes a refrigerant circuit and contains at least the compressor, an accumulator, etc. are disposed in a space which is surrounded by the two heat exchangers.

8 Claims, 6 Drawing Sheets

FIG. 6

| | | 0 | 1. 5 | 2. 5 | 4 | 5 | 6. 5 | 7. 5 | 9 | 10 | 11. 5 | 12. 5 | 14 | 15 | 16. 5 | 17. 5 | 19 | 20 |
|---|---|---|---|---|---|---|---|---|---|---|---|---|---|---|---|---|---|---|
| 5HP P/C COMPRESSOR (2 ROTARY) | LOW-PRESSURE VALVE | OFF | ON (OPEN) | ON | OFF (CLOSE) | OFF | ON | ON | OFF | OFF | ON | ON | OFF | OFF | ON | ON | OFF | OFF |
| | HIGH-PRESSURE VALVE | OFF | OFF (CLOSE) | OFF | ON | ON (OPEN) | OFF | OFF | ON | ON | OFF | OFF | ON | ON | OFF | OFF | ON | ON |
| 5HP A/C COMPRESSOR (2 ROTARY) | | OFF | OFF | OFF | OFF | OFF | ON | ON | ON | ON | OFF | OFF | OFF | OFF | ON | ON | ON | ON |
| 10HP SCROLL COMPRESSOR | | OFF | OFF | OFF | OFF | OFF | OFF | OFF | OFF | OFF | ON | ON | ON | ON | ON | ON | ON | ON |
| EXTERNAL SAVE VALVE | | OFF | ON | OFF | ON | OFF | ON | OFF | ON | OFF | ON | OFF | ON | OFF | ON | OFF | ON | OFF |

FIG. 7

| | | 0 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|---|
| 4HP P/C COMPRESSOR (2 ROTARY) | LOW-PRESSURE VALVE | OFF | ON (OPEN) | ON | OFF | OFF | ON | ON | OFF | OFF | ON | ON | OFF | OFF | ON | ON | OFF | OFF |
| | HIGH-PRESSURE VALVE | OFF | OFF (CLOSE) | OFF | ON | ON | OFF | OFF | ON | ON | OFF | OFF | ON | ON | OFF | OFF | ON | ON |
| 4HP A/C COMPRESSOR (2 ROTARY) | | OFF | OFF | OFF | OFF | OFF | ON | ON | ON | ON | OFF | OFF | OFF | OFF | ON | ON | ON | ON |
| 8HP SCROLL COMPRESSOR | | OFF | OFF | OFF | OFF | OFF | OFF | OFF | OFF | OFF | ON | ON | OFF | OFF | ON | ON | OFF | OFF |
| EXTERNAL SAVE VALVE | | OFF | ON | OFF | ON | OFF | ON | OFF | ON | OFF | ON | OFF | ON | OFF | ON | OFF | ON | OFF |

POWER CONTROLLABLE TYPE AIR CONDITIONER

BACKGROUND OF THE INVENTION

1. Field of the Invention

The present invention relates to an air conditioner in which the power (capacity) of a compressor is controllable (variable) in accordance with an air conditioning load.

2. Description of the Related Art

There is generally known an air conditioner (separation type air conditioner)in which plural indoor units are linked to plural outdoor units, and a compressor, a condenser, an expansion device and an evaporator are successively linked to one another to construct a refrigerant circuit. In this type air conditioner, the power (capacity) of the compressor as described above is controlled to be varied in accordance with an air conditioning load. In order to vary the power of the compressor, there has been hitherto proposed an inverter type compressor which controls its power by varying the frequency of power to be supplied to the compressor.

However, when an inverter compressor is used in the air conditioner as described above, the price of the air conditioner rises up unavoidably. In addition, the frequency components may have various adverse effects on peripheral electrical elements such as a microcomputer, etc. which are disposed around the inverter compressor. For example, the peripheral electrical elements suffer noises or a condenser (electrical part) is broken down.

On the other hand, there may be considered another type air conditioner which does not use any inverter compressor, and uses a rated compressor (a compressor whose power is invariable) and a refrigerant return mechanism for returning a part of refrigerant discharged from the rated compressor to a suck-in side of the compressor (for example, an accumulator) to perform multistage control operation with the rated compressor. However, this type air conditioner has such a disadvantage that the control operation cannot be smoothly performed, resulting in occurrence of hunting and limitation of the control range to an extremely narrow range. The occurrence of the hunting intensifies the fluctuation of a room temperature, so that a comfortable air conditioning atmosphere is unachievable.

Such a phenomenon becomes a critical problem particularly to a so-called large-capacity type air conditioner having plural outdoor units.

Further, when increase in power (horsepower) which is demanded in design (hereinafter referred to as "demand horsepower on design") is needed in the air conditioner as described above, it has been a general way to increase the number of outdoor units and link these plural outdoor units to one another to fabricate a so-called multi-type air conditioner.

When the demand horsepower on design is increased to fabricate an air conditioner having a high efficiency, in some cases it is better to increase the horsepower of an outdoor unit itself rather than to increase the number of outdoor units. However, there has not been hitherto proposed any outdoor unit which is usable in a separation type air conditioner having a large horsepower. If the outdoor unit is designed to have a large capacity, the number of compressors must be increased, and the capacity of a heat exchanger, an accumulator, etc. must be also increased. However, there has not been hitherto proposed any technical idea for efficiently accommodating various elements (such as a compressor, a heat exchanger, an accumulator, etc.) constituting the refrigerant circuit into the main body of an outdoor unit, and effectively performing maintenance of these accommodated elements.

SUMMARY OF THE INVENTION

Therefore, an object of the present invention is to provide a large-capacity type air conditioner in which plural outdoor units are linked to plural indoor units and which can control (vary) the power thereof with no inverter compressor.

Another object of the present invention is to provide an outdoor unit which can efficiently accommodate various elements constituting a refrigerant circuit, such as a heat exchanger, a compressor, an accumulator, etc., into the main body of an outdoor unit, and perform effective maintenance of the accommodated elements.

In order to achieve the above object, according to a first aspect of the present invention, an air conditioner is characterized by comprising plural indoor units, plural outdoor units which are linked to the plural indoor units, at least one of the plural outdoor units being provided with a compressor having a power control mechanism for partially inhibiting a compression work, and a controller for controlling the power control mechanism to vary the power of the compressor.

In the air conditioner according to the first aspect of the present invention, at least one outdoor unit is provided with plural compressors, and at least one of the plural compressors which are provided to the outdoor unit is provided with the power control mechanism, the power control mechanism being controlled by the controller so that the power of the compressor is variable.

In the air conditioner according to the first aspect of the present invention, the outdoor unit is further provided with a refrigerant return mechanism for returning a part of refrigerant discharged from the compressor to the suck-in side of the compressor, the power being variable by controlling the power control mechanism and the refrigerant return mechanism.

According to a second aspect of the present invention, an outdoor unit having a refrigerant circuit comprising a heat exchanger, a compressor, an accumulator, etc., is characterized in that substantially U-shaped two heat exchangers are accommodated in the main body of the outdoor unit so that the opening sides thereof are confronted to each other, and the other elements constituting the refrigerant circuit are accommodated in a space surrounded by the two heat exchangers.

In the outdoor unit according to the second aspect of the present invention, at least one of a service panel and a pipe connecting portion is provided at the center of the front face of the main body of the outdoor unit.

In the outdoor unit according to the second aspect of the present invention, air suck-in ports for the heat exchangers are d at both sides of the front face of the main body of the outdoor unit, and at least one of a service panel and a pipe connecting portion is provided at the center of the main body of the outdoor unit.

In the outdoor unit according to the second aspect of the present invention, the compressor is disposed so as to be exposed from the front face of the main body of the outdoor unit to the outside when the service panel is detached from the outdoor unit.

In the outdoor unit according to the second aspect of the present invention, a plurality of compressors are provided in the outdoor unit, and a compressor which is one of the plural compressors and is controlled to be driven for the longest time among the plural compressors is disposed so as to be exposed at the front of the front face of the main body of the outdoor unit when the service panel is detached.

BRIEF DESCRIPTION OF THE DRAWINGS

FIG. 6 is a table showing a stepwise control of compression power of 20 ps; and FIG. 7 is a table showing a stepwise control of compression power of 16 ps.

DETAILED DESCRIPTION OF PREFERRED EMBODIMENTS

Preferred embodiments according to the present invention will be described hereunder with reference to the accompanying drawings.

Figure 1:
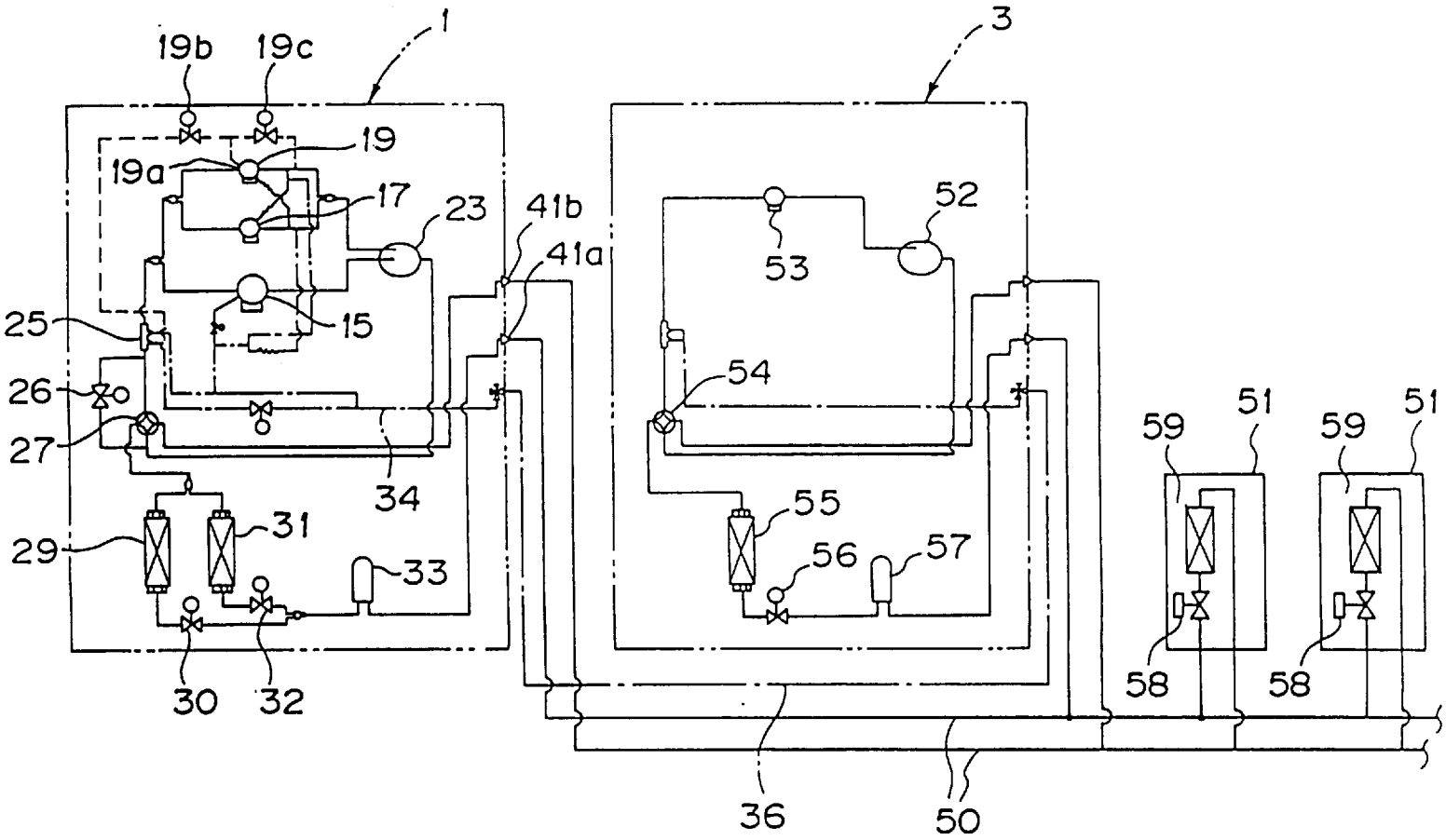
FIG. 1 is a refrigerant circuit diagram showing an embodiment of an air conditioner according to the present invention.

FIG. 1 shows an outdoor unit used in an air conditioner according to the present invention.

In FIG. 1, reference numeral 1 represents an outdoor unit of 20 horsepower [ps] (hereinafter referred to as "master unit"), and reference numeral 3 represents an outdoor unit of 10 [ps] (hereinafter referred to as "sub unit"). These master and sub units 1 and 3 are linked to each other through refrigerant pipes 50.

First, the "master unit" 1 will be described.

The master unit 1 has three compressors, that is, a rated compressor (scroll compressor) 15 of 10 ps, a rated compressor (rotary compressor) 17 of 5 ps, and a compressor 19 having a maximum power of 5 ps and also having a power control mechanism for controlling the output power of the compressor 19 to inhibit a part of a compression work of the compressor 19 (hereinafter referred to as "P/C compressor"). The "P/C compressor" 19 will be described hereunder.

The P/C compressor 19 has a control port 19*a* in its cylinders (as described later) in which refrigerant is compressed. When a high-pressure valve 19*b* is opened to apply high pressure to the control port 19*a* (a low-pressure valve 19*c* is closed), an internal power control mechanism (as described later) works to operate the P/C compressor 19 at a full power mode of 5 ps. On the other hand, when the low-pressure valve 19*c* is opened to apply low pressure to the control port 19*a* (the high-pressure valve 19*b* is closed), the internal power control mechanism works to operate the P/C compressor at a half power mode of 2.5 ps. The details of the power control mechanism will be described with reference to FIGS. 2 and 3.

Figure 2:
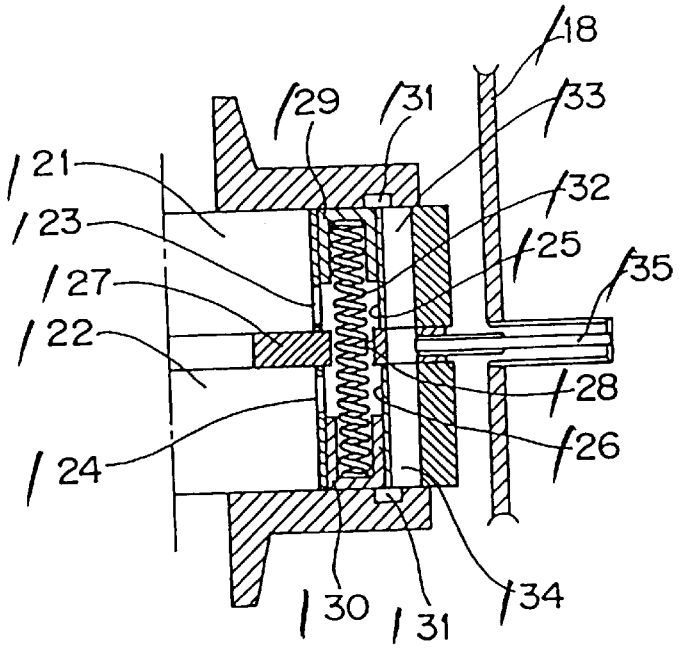
FIG. 2 is a cross-sectional view showing a power control (save) mechanism when a piston is shifted to the top dead center.
Figure 3:
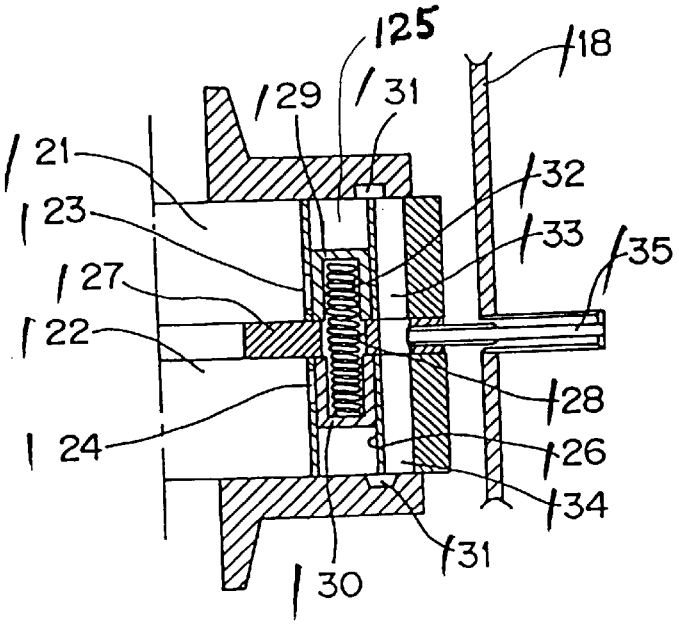
FIG. 3 is a cross-sectional view showing a power control (save) mechanism when a piston is shifted to the bottom dead center.

FIGS. 2 and 3 are diagrams showing the detailed construction of a power save mechanism which is an embodiment of the power control mechanism. As shown in FIGS. 2 and 3, the power save mechanism has a rotational compression element in a hermetic chamber 118 of the compressor 19. The rotational compression element is provided with an intermediate partition plate 127, and a pair of cylinders 121 and 122 which are disposed at both sides of the intermediate partition plate 127. In the rotational compressor element thus constructed, first holes 123 and 124 are formed in the inner side walls of the cylinders 121 and 122 respectively, chambers 125 and 126 are formed in the cylinders 121 and 122 respectively so as to intercommunicate with the first holes 123 and 124 respectively, and an opening 128 is formed in the intermediate partition plate 127 so as to intercommunicate with the chambers 125 and 126. Further, pistons 129 and 130 are provided in the chambers 125 and 126 of the cylinders 121 and 122 respectively, and a coil spring (a leaf spring or bellows may be used insofar as these members are formed of elastic member) 132 is bridged over both the pistons 129 and 130. The rotational compression element is further provided with chambers 133 and 134 which intercommunicate with the chambers 125 and 126 of the cylinders 121 and 122 respectively through recess portions 131 which are formed in the cylinders 121 and 122, and the intercommunication between each of the chambers 133 and 134 and the low-pressure side or high-pressure side is selectively allowed by the switching operation of the switching valve 19*b*, 19*c*.

According to the control of the power save mechanism 113 thus constructed, the pressure at the low-pressure side is applied as back pressure to the chambers 125 and 126 through the passage 135, the chambers 133 and 134 and the recess portion 131 to move the pistons 129 and 130 to the top dead center. Accordingly, as shown in FIG. 2, the first holes 123 and 124 are opened, so that the gas (refrigerant) being compressed in one cylinder 121 flows through the first hole 123, the chamber 125, the opening 128, the chamber 126 and the first hole 124 into the other cylinder 122 under suck-in operation to thereby inhibit about a half of compression work from being performed in the compressor 19. On the other hand, in normal operation, the pressure at a high-pressure side is applied as back pressure to the chambers 125 and 126 through the passage 135, the chambers 133 and 134 and the recess portion 131 to move the pistons 129 and 130 to the bottom dead center, and the first holes 123 and 124 are closed, whereby the gas (refrigerant) flow between the cylinders 121 and 122 is inhibited.

According to the power save mechanism 113 as described above, about 50% output power can be saved (i.e., about a half of the compression work of the compressor 19 is inhibited). Accordingly, 2.5 ps output power can be saved for the compressor of 5 ps. The ON/OFF operation of the power save mechanism 113 is performed by opening/closing the valves 19*b* and 19*c* in response to an instruction from a controller (not shown).

Returning to FIG. 1, the master unit 1 is further provided with an accumulator 23, an oil separator 25, a four-way change-over valve 27, two heat exchangers 29 and 31, expansion devices 30 and 32, a receiver tank 33, etc. as well as the three compressors 15, 17 and 19. Reference numeral 34 represents an oil line, and it is connected to a balance pipe 36.

The refrigerant which is passed through the oil separator 25 is normally directed to the four-way change-over valve 27. In order to further and more finely control the power of the compressor, an external save valve 26 serving as a refrigerant return mechanism is provided. In this embodiment, the external save valve 26 is disposed between the oil separator 25 and the accumulator 23 as shown in FIG. 1. When the refrigerant return mechanism is opened, a part of the compressed refrigerant (which corresponds to 1 ps, for example) is returned to the accumulator 23 (the suck-in side of the compressor) while bypassing the four-way change-over valve 27.

Next, the sub unit 3 will be described.

The sub unit 3 has an accumulator 52, a rated compressor 53, a four-way change-over valve 54, a heat exchanger 55, an expansion valve 56, a receiver tank 57, etc. as shown in FIG. 1 The rated compressor 53 has a power of 10 ps. The master unit 1 and the sub unit 3 are connected to the indoor units 51 through the refrigerant pipes 50. Each of the indoor units 51 mainly contains an expansion device 58 such as an electrical control valve or the like, and a heat exchanger 59 therein.

According to this embodiment, the total horsepower of the three compressors 15, 17 and 19 of the master unit 1 is equal to 20 ps (=10 ps+5 ps+5ps), and thus the total capacity of the two heat exchangers 29 and 31 is equal to 20 ps (10 ps+10 ps).

Figure 5:
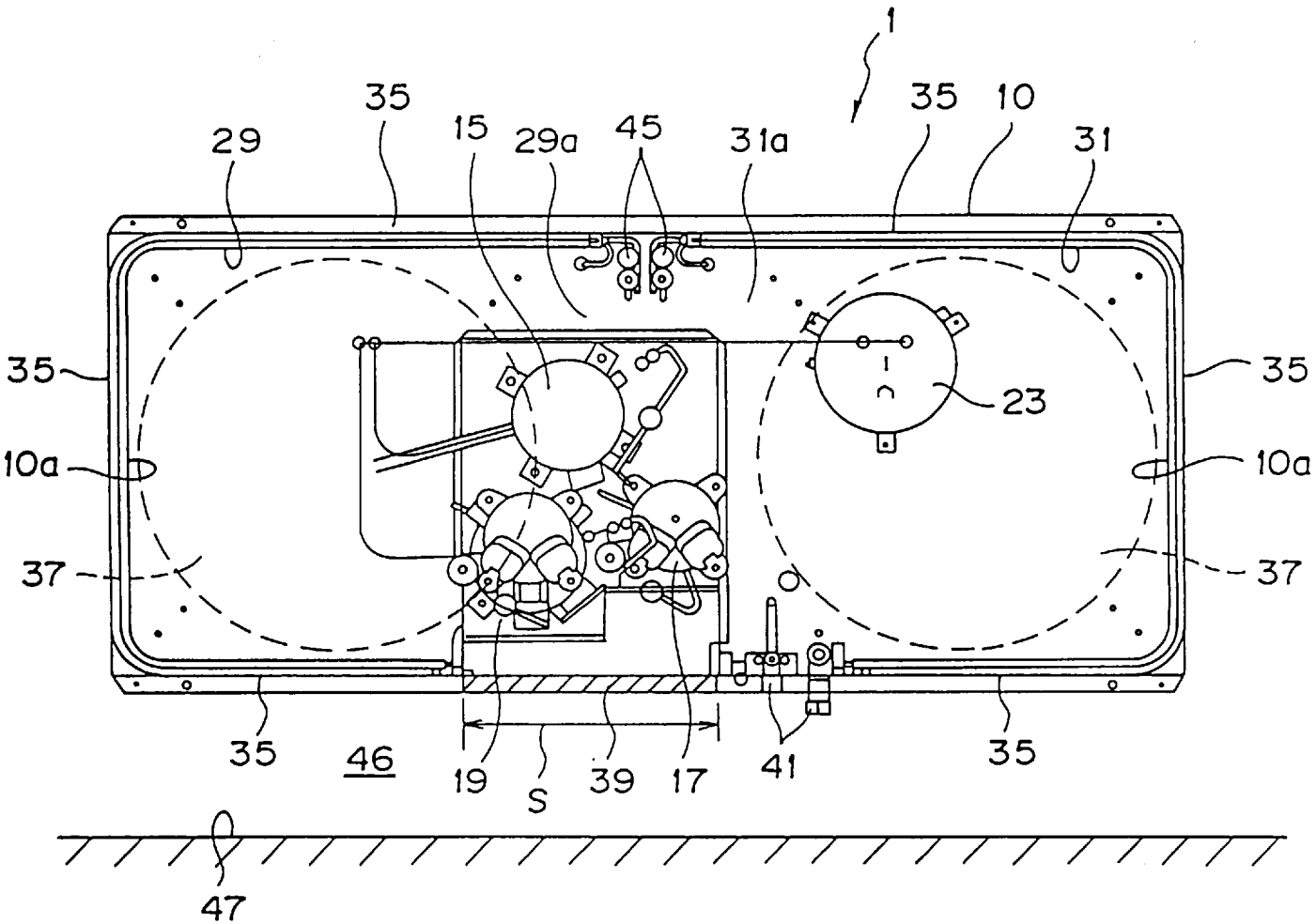
FIG. 5 is a cross-sectional view showing the outdoor unit (master unit)

The heat exchangers having the total capacity of 20 ps are estimated to be larger than that of the prior art. In this embodiment, the heat exchangers 29 and 31 are designed overall in a substantially U-shaped form (which is substantially the same as the prior art), however, the arrangement of these heat exchangers and the packing of the other elements are different from the prior art. That is, the heat exchangers are disposed in the main body 10 of the master unit 1 so that the opening sides 29*a* and 31*a* thereof are confronted to each other as shown in FIG. 5.

That is, the heat exchangers 29 and 31 are arranged symmetrically at the right and left sides of the main body. These heat exchangers are formed separately from each other, and accommodated tightly at both the corners 10*a* of the main body 1 of the master unit 1. Further, the other elements constituting the refrigerant circuit such as the three compressors 15, 17 and 19, the accumulator 23, the oil separator 25, the four-way change-over valve 27, etc. are accommodated in a space 100 surrounded by the two heat exchangers 29 and 31. Further, air suck-in ports 35 for taking air for heat exchange are formed on the periphery of the side faces of the main body 10 of the master unit 1, except for the center portion of the front face of the main body 10. The air taken from the air suck-in ports 35 is heat-exchanged in the heat exchangers 29 and 31, and then discharged through a discharge fan 37 provided on the ceiling face.

Figure 4:
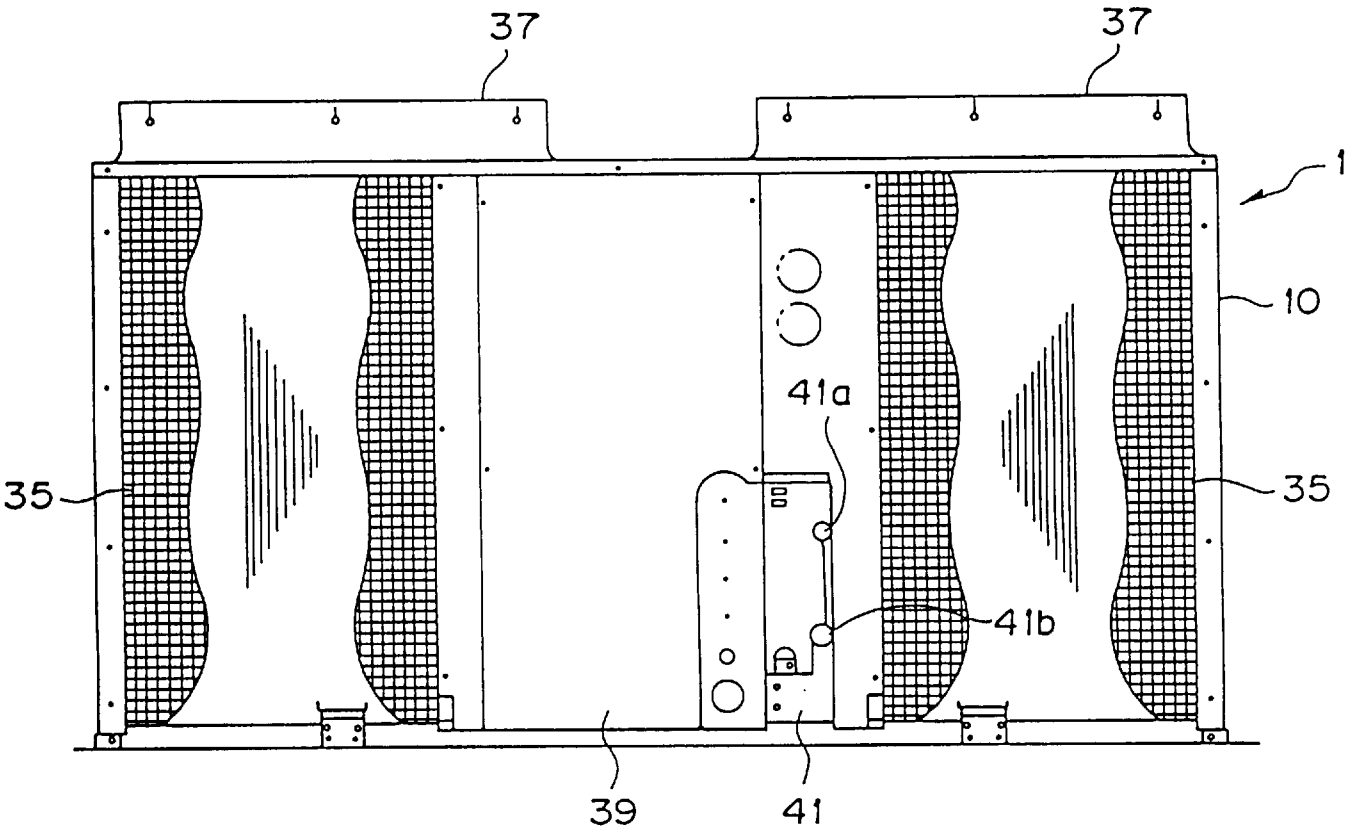
FIG. 4 is a front view showing an outdoor unit (master unit)

As shown in FIG. 4, a service panel 39 and a pipe connection portion 41 are provided at the center of the front face of the main body 10 of the master unit 1. The pipe connection portion 41 comprises various service valves for the gas pipe and the liquid pipe, etc.

In the pipe connection portion 41, a service valve (narrow pipe) 41*a* of the liquid pipe and a service valve (thick pipe) 41*b* of the gas pipe are vertically arranged on a line so that the service valve 41*a* is located at a higher position than the service valve 41*b*. As compared with the case where the service valves 41*a* and 41*b* are laterally arranged (prior art), the vertical arrangement of the service valves 41*a* and 41*b* can reduce the lateral dimension of the master unit 1 to a smaller size. The service valve (thick pipe) 41*b* of the gas pipe is located at a lower position than the service valve (narrow pipe) 41*a* of the liquid pipe because a connection work of the gas pipe which is led from the four-way change-over valve is facilitated. The link portion of the four-way change-over valve 27 to the gas pipe faces downwardly, so that it is difficult to lead upwardly the gas pipe which is led from the link portion of the four-way change-over valve 27 of the master unit 1. Accordingly, it is rather easier to lead the gas pipe downwardly.

When the service panel 39 is opened (detached), the compressors 15, 17 and 19 are exposed to the outside as shown in FIG. 5. In the air conditioner as described above, the P/C compressor 19 is most preferentially driven for a longer time as compared with the other compressors 15 and 17. Accordingly, in general, maintenance is more frequently performed on the P/C compressor 19 than the other compressors 15 and 17. Therefore, in consideration of facility of maintenance, the P/C compressor 19, the compressor 17 and the compressor 15 are disposed in this order from the front side of the front face of the main body 10 so that the P/C compressor 19 is located and exposed at the forefront of the front face of the main body 10 of the master unit 1. Further, flow dividers 45 which are connected to the heat exchangers 29 and 31 are disposed at the back face side of the main body in the master unit 1 as shown in 5. When the flow dividers 45 are disposed at the back face side of the main body, the opening space S at the front face side of the main body can be kept broader as compared with the case where the flow dividers 45 are arranged at the front face side of the main body.

As described above, according to this embodiment, when the service panel 39 is opened (detached), the compressors, etc. are frequently exposed to the outside, so that the facility of the maintenance is enhanced.

Further, in this embodiment, the master unit 1 may be disposed so that a service/maintenance passage (space) 46 is ensured between the main body 10 of the air conditioner and the wall surface 47. The passage 46 provides a sufficient air suck-in space in the neighborhood of the air suck-in port 35 at the front side of the main body.

According to the present invention, the heat exchangers 29 and 31 are designed to have a substantially U-shape, and accommodated in the main body 10 of the master unit 1 so that the opening sides thereof are confronted to each other. Therefore, even when the heat exchangers 29 and 31 must be designed in a large size, the master unit 1 itself can be designed in a compact size because the other elements constituting the refrigerant circuit, such as the compressor, the accumulator, etc., are accommodated in the space which is surrounded by the two heat exchangers. Further, the service panel 39 is provided at the center portion of the main body 10, so that the maintenance is allowed to be performed on the elements constituting the refrigerant circuit by merely opening the service panel 39, so that the facility of the maintenance can be more enhanced.

Next, the power control operation of the compressor will be described in detail.

According to this embodiment, the compression power is controlled at 17 stages (levels) in the horsepower range from 0 ps to 20 ps as shown in 6.

For example, when a demand horsepower is equal to 1.5 ps, the P/C compressor 19 is operated and all the other compressors 15 and 17 are stopped. Further, the low-pressure valve 19*c* is opened and the high-pressure valve 19*b* is closed. In addition, the external save valve 26 is opened. Through this operation, the power control mechanism is operated to drive the P/C compressor 19 at 2.5 ps (half power). At the same time, the refrigerant return mechanism is operated to return the refrigerant corresponding to 1 ps to the accumulator, so that totally power of 1.5 ps (=5 ps/2−1 ps) is obtained.

When the demand horsepower is equal to 2.5 ps, the P/C compressor 19 is operated at a half power, and all the other compressors are stopped. Further, only the low-pressure valve 19*c* is opened.

When the demand horsepower is equal to 4 ps, the P/C compressor 19 is operated, and all the other compressors 15 and 17 are stopped. Further, the high-pressure valve 19*b* is opened and the low-pressure valve 19*c* is closed. In addition, the external save valve 26 is opened. Through this operation, the P/C compressor 19 is driven at 5 ps (full power). At the same time, the refrigerant return mechanism is operated to return the refrigerant corresponding to 1 ps, so that totally 4 ps power is obtained.

As described above, the P/C compressor 19 and the 5 ps rated compressor (A/C compressor) 17 are alternately driven until the demand horsepower reaches 10 ps as shown in FIG. 6, and if occasion demands, the power is stepwise controlled by opening/closing the external save valve 26.

When the demand horsepower is equal to 11.5 ps, the 10 ps rated compressor (scroll) 15 is driven, and the P/C compressor 19 is driven. Further, the low-pressure valve 19*c* is opened and the high-pressure valve 19*b* is closed. In addition, the external save valve 26 is opened. With this operation, the rated compressor 15 is driven at 10 ps, and the power control mechanism works to operate the P/C compressor 19 at 2.5 ps (half power). At the same time, the refrigerant return mechanism works to return the refrigerant corresponding to 1 ps, so that totally 11.5 ps power is obtained.

As described above, the rated compressor 15 is continued to be driven, and the P/C compressor 19 and the 5 ps rated compressor 17 are alternately driven. Further, the external save valve 26 is opened/closed case by case, whereby the stepwise power control can be performed.

In short, according to this embodiment, by controlling the P/C compressor 19 and the external save valve 26, a demanded variable output power can be obtained by only the rated compressor in place of the inverter compressor.

Accordingly, the adverse effects such as the noises, etc. by the inverter compressor can be prevented, and a low-price air conditioner can be provided.

FIG. 7 is a table showing the control operation of another embodiment.

According to this embodiment, the master unit 1 includes a 8 ps rated compressor (scroll) 15, a 4 ps rated compressor (rotary) 17, and a 4 ps P/C compressor 19. Overall, the master unit 1 has horsepower of 16 ps. In this case, the stepwise power control can be performed every 1 ps from 0 ps to 16 ps as show in FIG. 7.

For example, when the demand horsepower is equal to 5 ps, the P/C compressor 19 and the 4 ps rated compressor 17 are driven, and the low-pressure valve 19*c* is opened while the high-pressure valve 19*b* is closed. Further, the external save valve 26 is opened. With this operation, the rated compressor 17 is driven at 4 ps, and the P/C compressor 19 is driven at 2 ps (half power). At the same time, the refrigerant return mechanism is operated to return the refrigerant corresponding to 1 ps, so that totally 5 ps power is obtained. When the demand horsepower is equal to 15 ps, the 8 ps rated compressor 15 and the 4 ps rated compressor 17 are driven, and the P/C compressor 19 is driven. Further, the high-pressure valve 19*b* is opened and the low-pressure valve 19*c* is closed. Further, the external save valve 26 is opened. Through this operation, the rated compressor 15 is driven at 8 ps, the rated compressor 17 is driven at 4 ps, and the power control mechanism works to drive the P/C compressor 19 at 2 ps (half power). At the same time, the refrigerant return mechanism is operated to return the refrigerant corresponding to 1 ps, so that totally 15 ps power is obtained.

According to the present invention, in the relatively-large capacity of air conditioner in which plural outdoor units are connected to plural indoor unit, the compression work can be partially inhibited (i.e., the compression power is made controllable (variable) without inverter compressor. Therefore, the adverse effects such as noises, etc. due to the inverter compressor can be prevented, and the low-price air conditioner can be provided.

Further, according to the present invention, the two heat exchangers are designed in a substantially U-shaped form, and accommodated in the main body of the outdoor unit so that the opening sides thereof are confronted to each other. Therefore, the other elements constituting the refrigerant circuit can be accommodated in the space which is surrounded by the two heat exchangers, so that the outdoor unit can be designed in a compact size. Further, the service panel which can be opened/closed (or detachably mounted) is provided at the center portion of the front face of the main body, so that the maintenance can be readily performed on the elements constituting the refrigerant circuit.

What is claimed is:

1. An air conditioner in which plural outdoor units are connected to plural indoor units, characterized in that at least one outdoor unit is provided with a compressor having a power control mechanism for inhibiting a part of a compression work, said compressor comprising a pair of cylinders, and said power control mechanism having a control valve that is operative to control a flow-in of refrigerant from one cylinder under compression operation to the other cylinder under suck-in operation.

2. The air conditioner of claim 1, wherein said control valve comprises a piston that is urged in a fixed direction by a spring, and moved in a predetermined direction by selectively supplying high or low pressure gas thereto to control the flow-in of the refrigerant from one of said cylinders under the compression operation to the other of said cylinders under the suck-in operation.

3. An air conditioner in which plural outdoor units are connected to plural indoor units, characterized in that at least one outdoor unit is provided with plural compressors which contain a compressor having a power control mechanism for inhibiting a part of a compression work, said compressor comprising a pair of cylinders, and said power control mechanism having a control valve that is operative to control a flow-in of refrigerant from one cylinder under compression operation to the other cylinder under suck-in operation.

4. The air conditioner of claim 3, wherein said control valve comprises a piston that is urged in a fixed direction by a spring, and moved in a predetermined direction by selectively supplying high or low pressure gas thereto to control the flow-in of the refrigerant from one of said cylinders under the compression operation to the other of said cylinders under the suck-in operation.

5. An air conditioner in which plural outdoor units are connected to plural indoor units, characterized in that at least one outdoor unit is provided with a compressor having a power control mechanism for inhibiting a part of a compression work and a refrigerant return mechanism for returning a part of refrigerant discharged from said compressor to a suck-in side of said compressor, said compressor comprising a pair of cylinders, and said power control mechanism having a control valve that is operative to control a flow-in of refrigerant from one cylinder under compression operation to the other cylinder under suck-in operation.

6. The air conditioner of claim 5, wherein said control valve comprises a piston that is urged in a fixed direction by a spring, and moved in a predetermined direction by selectively supplying high or low pressure gas thereto to control the flow-in of the refrigerant from one of said cylinders under the compression operation to the other of said cylinders under the suck-in operation.

7. An air conditioner in which plural outdoor units are connected to plural indoor units, characterized in that at least one outdoor unit is provided with plural compressors which contain a compressor having a power control mechanism for inhibiting a part of a compression work, and a refrigerant return mechanism for returning a part of refrigerant discharged from said compressor to a suck-in side of said compressor, said compressor comprising a pair of cylinders, and said power control mechanism having a control valve that is operative to control a flow-in of refrigerant from one cylinder under compression operation to the other cylinder under suck-in operation.

8. The air conditioner of claim 7, wherein said control valve comprises a piston that is urged in a fixed direction by a spring, and moved in a predetermined direction by selectively supplying high or low pressure gas thereto to control the flow-in of the refrigerant from one of said cylinders under the compression operation to the other of said cylinders under the suck-in operation.

* * * * *